US005970562A

United States Patent [19]

Lalevee, Sr.

[11] Patent Number: 5,970,562

[45] Date of Patent: Oct. 26, 1999

[54] NO DRIP TOOTH BRUSH AND SHIELD

[76] Inventor: Russell R. Lalevee, Sr., P.O. Box 338, Chatham, Mass. 02633

[21] Appl. No.: 09/074,573

[22] Filed: May 7, 1998

[51] Int. Cl.[6] ..... A46B 9/04

[52] U.S. Cl. ..... 15/167.1; 15/248.1; D4/116

[58] Field of Search ..... 15/248.1, 167.1, 15/167.2, 143.1; 206/362.2, 362.3, 361; D4/104, 108, 110, 113, 138; 132/308

[56] References Cited

U.S. PATENT DOCUMENTS

| | | | |
|---|---|---|---|
| Re. 23,975 | 4/1955 | Keely | 15/248.1 |
| D. 289,583 | 5/1987 | Chan | D4/104 |
| D. 384,207 | 9/1997 | Underwood | D4/104 |
| 851,550 | 4/1907 | Nevius | 15/248.1 |
| 860,527 | 7/1907 | Cochrane | 15/167.1 |
| 1,501,020 | 7/1924 | Small | 15/167.1 |
| 2,201,190 | 5/1940 | Mastrud | 15/248.1 |
| 2,394,640 | 2/1946 | Singer | 15/248.1 |
| 2,426,531 | 8/1947 | Stevason | 15/248.1 |
| 3,061,864 | 11/1962 | Miller | 15/248.1 |
| 3,755,848 | 9/1973 | Mutrie | 15/248.1 |
| 4,961,717 | 10/1990 | Hickey | 206/362.2 |

FOREIGN PATENT DOCUMENTS

| | | | |
|---|---|---|---|
| 634548 | 2/1928 | France | 15/248.1 |
| 717287 | 1/1932 | France | 15/248.1 |
| 2440172 | 7/1980 | France | 15/248.1 |
| 449684 | 9/1927 | Germany | 15/248.1 |
| 6-90822 | 4/1994 | Japan | 15/167.1 |
| 183659 | 4/1936 | Switzerland | 15/248.1 |
| 13552 | 10/1891 | United Kingdom | 15/248.1 |

*Primary Examiner*—Gary K. Graham

[57] ABSTRACT

The present invention relates to a device attached to a standard type tooth brush. The device provides controlled collection of tooth paste fluid foam escaping from the oral cavity during a tooth brushing procedure. The device consist of a tubular member made of plastic material, one end closed, the other end having a funnel shaped orifice secured to the handle of a tooth brush.

1 Claim, 3 Drawing Sheets

NO DRIP TOOTH BRUSH AND SHIELD

BACKGROUND OF THE INVENTION

The present invention relates to controlling and collection of liquid tooth paste foam created during a typical tooth brushing procedure. This oozing messy foam created during brushing spills out of the oral cavity and flows down the tooth brush handle to soil the user's hand-wrist-and clothing. In an attempt to overcome and avoid this messy part of tooth brushing, the user must lean over a basin in an awkward position. The taller the user is, the more irk-some bending over a basin becomes. This brushing teeth problem is greater for the elderly, those people with arthritis, those that are confined to a wheel chair and bed ridden patients. Those people brushing their teeth after each meal require special caution to prevent the flow of tooth paste foam reaching their clothing, especially if dressed in business atire or casual clothes. It is desirable to provide a new and improved approach so people can brush their teeth without a hassle.

SUMMARY OF THE INVENTION

Accordingly, it is the general purpose and object of the present invention to minimize an existing messy tooth brushing procedure. Another object of the present invention is to provide means to control the tooth paste foam oozing out of the oral cavity down over the user's hand-wrist-and clothing. Another object of the invention is to provide a comfortable brushing stance during tooth brushing and to enable a person brushing their teeth to stand erect, face a mirror and maintain complete control over the flowing foam out of the oral cavity. A quick flip of the wrist over a basin will immediately empty the tooth paste foam from the collector shield. A further object of the invention is the provision of the collector shield when permanently added to the tooth brush handle, will not increase the bulk of the tooth brush, whereby this additional body may be effected at the factory without any significant change in packaging, shipping or distributing procedures. The invention will be described for the purpose of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
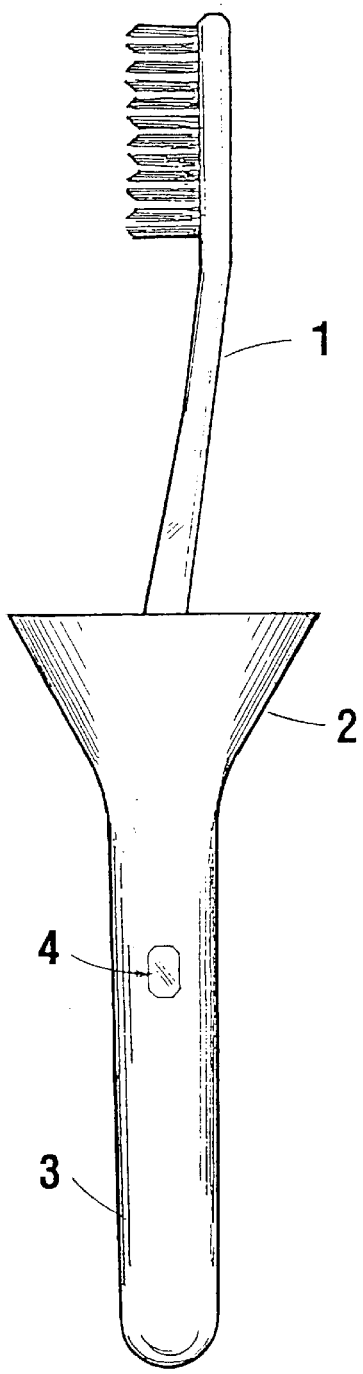
FIG. 1 is a side elevation of a first embodiment of a plastic molded collector which receives a toothbrush therein.

Referring to FIG. 1, a toothpaste foam collector 3 is shown formed as an elongated tubular body of slightly resilient plastics material. The tubular body has an inner surface and an outer surface defined by a wall. The material of the body may be for example low density polyethylene to permit with slight pressure, engagement and releasing of a handle of a toothbrush 1 therein. The tubular body is closed at one end and open at the other. The open end includes a funnel shaped portion 2 for receipt of the foam. Foam created during the brushing of teeth which runs down the handle of the toothbrush 1 is caught by the funnel shaped portion and collected therein.

Figure 2:
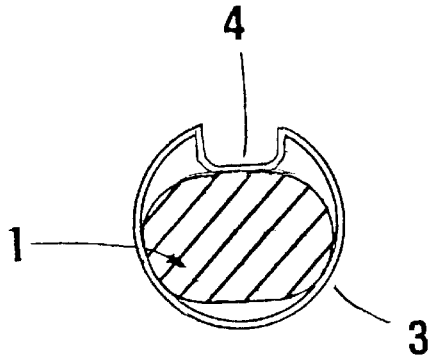
FIG. 2 is a cross section of the collector of FIG. 1 at line 2—2.

Referring to FIG. 2, a cross section through a mid-portion of the collector 3 is shown. The mid-portion includes a handle engaging member 4. The member 4 is formed by part of the wall of the body extending inwardly such that a depression or recess is formed on the outer surface and a projection is formed on the inner surface. The handle engaging member 4 acts to hold the wall of the collector in spaced relationship with the toothbrush handle.

Figure 3:
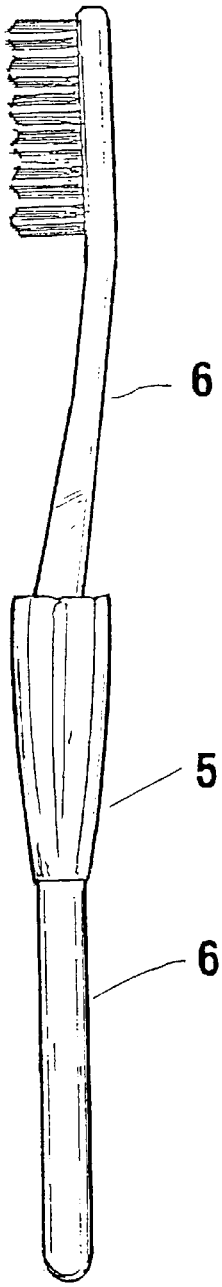
FIG. 3 is a side elevation of a second embodiment wherein a foldable collector is coupled with a toothbrush.

Referring to FIG. 3, a second embodiment is shown. A foam collector 5 is attached to a toothbrush 6. The collector 5 is permanently attached to the brush 6 and is of flexible plastics material which can be opened or closed to either an expanded or retracted position.

Figure 4:
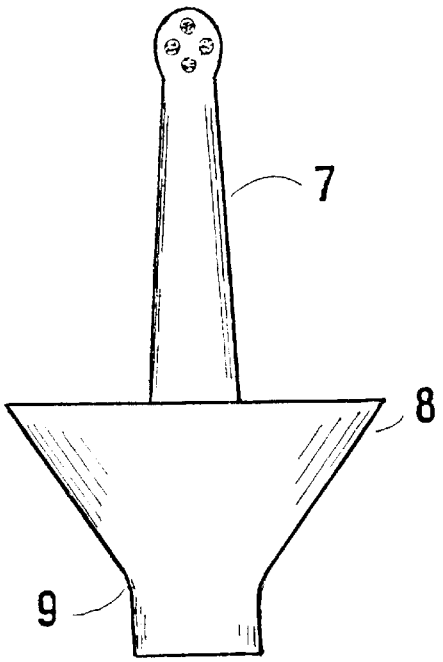
FIG. 4 is a side elevation of a third embodiment of a collector.

Referring to FIG. 4, a third embodiment is shown. A foam collector 9 is shown adapted to receive a motorized toothbrush 7 therein. The collector 9 includes a funnel shaped portion 8 for the collection of foam.

Figure 5:
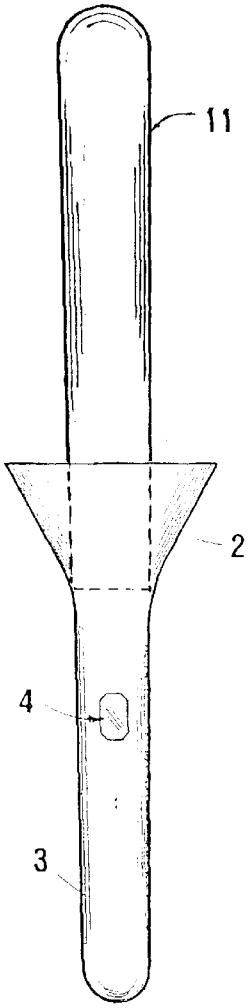
FIG. 5 is an illustration FIG. 1 but including a cover.

Referring to FIG. 5, the collector 3 of FIG. 1 is shown including a cover 11 thereon to completely enclose a toothbrush received in the collector.

Figure 6:
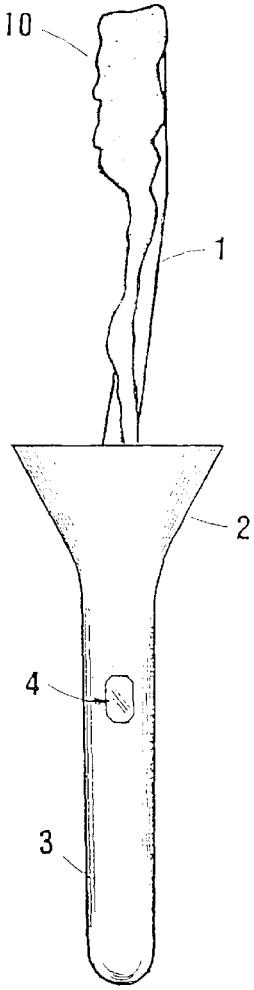
FIG. 6 is an illustration of the flow of toothpaste foam into the collector of FIG. 1.

Referring to FIG. 6, the collector 3 of FIG. 1 is shown in use as a foam 10 is received therein.

Figure 7:
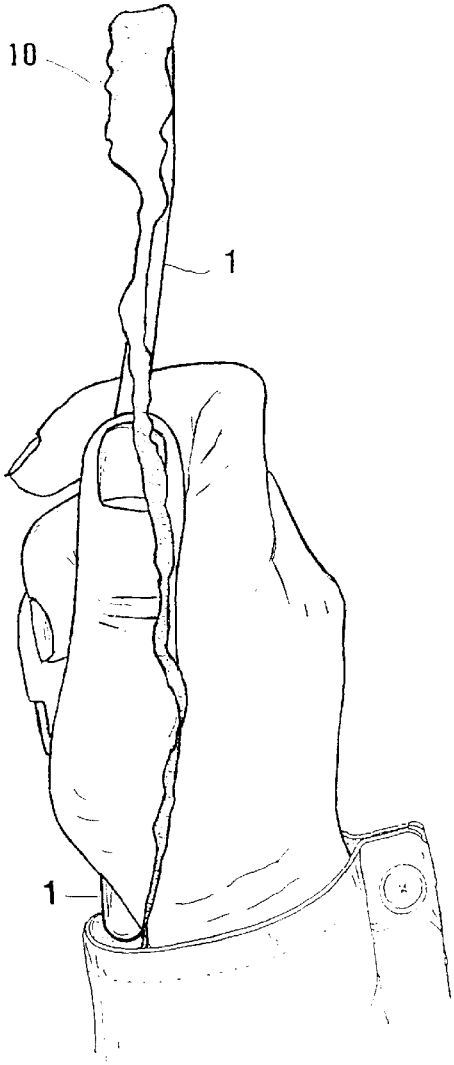
FIG. 7 is an illustration of the flow of toothpaste foam flowing onto a user of a toothbrush without a collector.

Referring to FIG. 7, the toothbrush 1 is shown in use without a collector. The foam 10 runs over the hand of a user.

What is claimed is:

1. A toothbrush system for brushing teeth of a user, said system comprising;

a toothbrush, said toothbrush having an elongated handle with a first end and a second end, said first end having a bristled head thereon;

a foam collector, said collector comprises a one piece, elongated tubular body of slightly resilient plastics material, the tubular body is closed at a first end, open at a second end and has a middle portion therebetween, the tubular body has an inner surface and an outer surface defined by a wall, the second end includes a funnel shaped portion for receipt of foam developed in a tooth brushing operation, the mid-portion includes a handle engaging member, the handle engaging member is formed by a part of the wall of the middle portion of the body extending inwardly such that a depression is formed on said outer surface and a projection is formed on said inner surface;

an elongated tubular cover having a first open end and a second closed end;

said second end of said toothbrush handle is received into the tubular body of said collector such that said handle engages said handle engaging member of said collector and is held therein by the resiliency of said material, said cover is received over said bristled head and engages said collector such that said toothbrush is enveloped.

* * * * *